US006237481B1

(12) United States Patent
Zimmer

(10) Patent No.: US 6,237,481 B1
(45) Date of Patent: May 29, 2001

(54) APPARATUS FOR PROCESSING A MATERIAL WEB

(76) Inventor: Johannes Zimmer, Ebenstaler Strasse 133, 9020 Klagenfurt (AT)

( * ) Notice: Subject to any disclaimer, the term of this patent is extended or adjusted under 35 U.S.C. 154(b) by 0 days.

(21) Appl. No.: 09/316,147

(22) Filed: May 21, 1999

(30) Foreign Application Priority Data

May 23, 1998 (DE) ..... 298 0 9883 U

(51) Int. Cl.[7] ..... B30B 3/04
(52) U.S. Cl. ..... 100/170; 68/258
(58) Field of Search ..... 100/168, 170; 68/258; 118/414, 249

(56) References Cited

U.S. PATENT DOCUMENTS

| | | | | |
|---|---|---|---|---|
| 1,184,294 | * | 5/1916 | Aitken | 100/168 |
| 2,851,869 | * | 9/1958 | Quoos et al. | 100/170 |
| 2,878,778 | | 3/1959 | Kusters . | |
| 3,001,390 | * | 9/1961 | Zimmer | 100/170 |
| 3,233,537 | * | 2/1966 | Beinke | 100/170 |
| 3,760,615 | | 9/1973 | Bahnsen . | |
| 5,255,539 | * | 10/1993 | Zimmer | 118/249 |
| 5,303,440 | * | 4/1994 | Zimmer . | |
| 5,599,392 | * | 2/1997 | Liang et al. | 118/414 |

FOREIGN PATENT DOCUMENTS

| | | |
|---|---|---|
| 296 19 695 | 2/1998 | (DE) . |
| 534 930 | 3/1993 | (EP) . |

* cited by examiner

*Primary Examiner*—Stephen F. Gerrity
(74) *Attorney, Agent, or Firm*—Mattingly, Stanger & Malur, P.C.

(57) ABSTRACT

A material web is processed in a contact zone between a stationary roller and a driven working roller. The working roller diameter is smaller than the diameter of the stationary roller. The working roller is displaceable in all directions transverse to the length of the movement of the web. The working roller is pressed against the stationary roller by a presser that presses on a peripheral area of the working roller opposite the contact zone. The pressing operation is continuous over the working width of the working roller and the material web is permitted to pass through the contact zone between the working roller and the stationary roller.

14 Claims, 3 Drawing Sheets

APPARATUS FOR PROCESSING A MATERIAL WEB

BACKGROUND OF THE INVENTION

1. Field of the Invention

The invention concerns an apparatus for processing a material web comprising a stationary backing roller extending the length of the device, a working roller which can be displaced to press against the latter and has a small diameter in relation to the backing roller diameter, a pressing device by means of which the working roller can be pressed against the backing roller along a contact zone, which is continuous over the working width and allows the material web to pass through it, wherein the pressing device has a pressing body with a pressing surface, against which the working roller comes to lie on its peripheral area opposite the contact zone, and a supporting element, arranged separately form the pressing body, with a support body surface, on which the working roller comes to lie during the pressing operation. Such apparatuses are used particularly as dyeing devices for squeezing, i.e. for the dehydration and dyeing of webs saturated with dye, so-called padding machines.

2. Prior Art

An apparatus of this type is familiar from EP 0 534 930. Here both a stationary and a moving bearing bed are each provided with at least one cylindrical pressing body for the pressure application of a working roller, which is conceived as a revolving roller driven by a fixed mating roller. The stationary pressing body is a supporting body, which operates as a passive counterpressure or backing body against the pulling power exercised by the mating roller on the working roller. Such a familiar arrangement can result in disadvantageous spline effects and forces operating between the pressing/supporting bodies. The running of the working roller is impaired, and problems with reproducing working conditions can occur. The attempt has been made to counteract such disadvantageous effects by providing the beds of the bearings with elastic bolsters and deflection-controlled rollers. DE-U-296 19 695 suggests arranging the working roller so that it is displaceable in the contact position with three degrees of freedom, whereby a pressing body needs to be provided with a bearing bed with which the working roller meshes. A stationary backing or mating roller forms a drive roller to make possible the motional bearing of the pressing body in combination with the working roller. In the event of only a slight frictional force operating in the contact zone, in addition the working roller needs to be driven. Such a device achieves an automatic adjustment of the working roller to the operating conditions. In some cases, however, problems will occur with regard to reproducible processing results.

With yet another apparatus (U.S. Pat. No. 2,878,778) a web is fed between two pressure rollers. Each pressure roller is mounted on a pair of backing or mating rollers. One of the pressure rollers and the mating rollers are driven. The construction of the device is costly. The variety of rollers causes problems with regard to setting, reproducibility and cleaning.

3. Objects of the Invention

In contrast to prior art, the present invention has as its major object to alleviate said problems and to improve apparatus of the described type for processing material webs.

In particular, it is an object of the present invention to make such improvements with regard to simplicity of construction, assembly and servicability, adjustability, operational function and results, and system cleaning.

SUMMARY OF THE INVENTION

In an apparatus comprising a stationary backing or mating roller (the term mating roller being used in this context hereinbelow); a displaceable working roller arranged to press against the mating roller in a contact zone upon being charged with pressure force and having a smaller diameter than the mating roller, with the contact zone being continuous over a desired working width and allowing the web to pass through it; a pressing device including a pressing body with a pressing surface to engage the working roller on a peripheral area thereof which is on the roller's side opposite the contact zone; and a supporting element separated from the pressing body and having a support body surface to engage the working roller during the pressing operation; these objects are achieved in that the displaceable working roller is connected to a roller drive and forms a peripheral drive for the revolving mating roller, whereby the working roller in its driven and pressed-against position drives the material web through the contact zone, the supporting element, viewed in the direction of rotation of the working roller, is located in the area between the latter and the pressing body and the feed-in of the web into the contact zone is provided between the supporting element and the mating roller. An essential measure consists in the fact that the working roller, whose diameter is small in relation to the diameter of the mating roller, forms the direct motive source of the device in such a way that the mating roller is only made to revolve via the web without being self-propelled. The supporting element is provided on the side of the device facing the web feed-in, independent of the pressing facility/device, in the area between the latter and the mating roller. This arrangement of the supporting element in front of the contact zone helps the operation of the working roller, which can be moved in the direction of contact and essentially perpendicular to this, to remain stable. In addition propulsion by means of the small roller ensures a particularly quiet and stable operation of the rollers. Owing to the arrangement of the supporting element in combination with the self-drive of the displaceable working roller and the pick-up of the mating roller, dynamic effects are reduced on the supporting element. It is likewise advantageous that, viewed from the direction of rotation of the working roller, the peripheral area of the same remains free behind the contact zone towards the pressing facility. This makes assembly and cleaning considerably easier.

A particularly advantageous embodiment consists in the pressing body and the supporting element being constructed as an L-shape, when viewed in front sectional view, with flat sliding surfaces arranged at least approximately at right angles to each other. This arrangement is advantageously so provided that the lines of contact on the working roller, viewed from the direction of rotation of the roller and proceeding from the line of contact on the pressing body, come to lie at peripheral angle intervals of approx. 90°, 90°, 180°. This also allows an operation which is particularly low on wear and friction to achieve an optimum reduction of surfaces sliding against each other.

It is particularly useful, especially in connection with the aforesaid embodiments, that the axles of the working roller and mating roller lie on the same, at least approximately horizontal plane, the web runs from bottom to top and the working roller comes to lie at least with the greatest part of its own weight on the support body surface. It is useful for this device arrangement in particular that the pressing body is constructed as a plate which can be inserted and removed between the working roller and a pressure generating device of the pressing device on the side of the apparatus including the web delivery. It is particularly advantageous, too, if the pressing body is arranged so that is is displaceable with at least two degrees of freedom for applying pressure, while at the same time being supported on a stationary element between the pressure generating device and the working roller. Thus, operational positioning and motional stability are achieved for a broad spectrum of applications and settings.

Especially in combination with the horizontal arrangement of working roller and mating roller, the pressing body can usefully lie against the apex of the working roller, which is determined by the distance from the axle of the mating roller A=d+D/2, with d=the working roller diameter and D=the mating roller diameter. It is particularly advantageous, however, that the pressing body, viewed in the direction of rotation of the working roller, lies in front of the said working roller apex, but in proximity to it. Thus the distance, measured in a straight line, between the pressing body point of contact and the mating roller point of contact at least approximately conforms to the working roller diameter. It is particularly advantageous, especially in combination with this arrangement, if the support body surface of the supporting element and the imaginary tangential surface, which is determined by the tangent of contact shared by the two rollers, are aligned at an angle $\alpha \leqq 90°$.

BRIEF DESCRIPTION OF THE DRAWINGS

Further objects of the present invention will be apparent from the following description and claims and are illustrated in the accompanying drawings which schematically show a preferred embodiment of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims. In the drawings:

DESCRIPTION OF THE PREFERRED EMBODIMENTS

Figure 1:
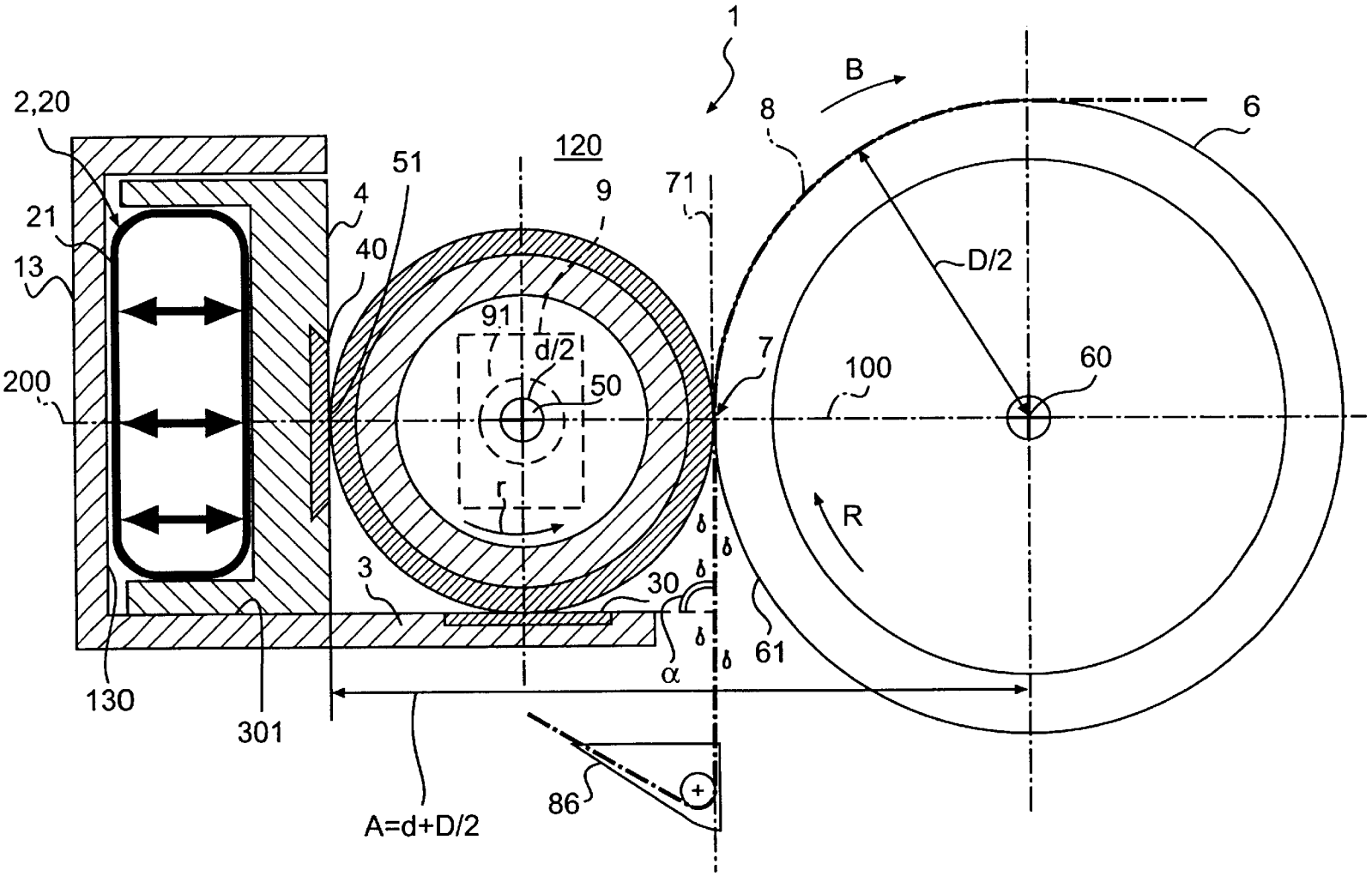
FIG. 1 is a profile cross-section of a device according to the invention in the working position.
Figure 2:
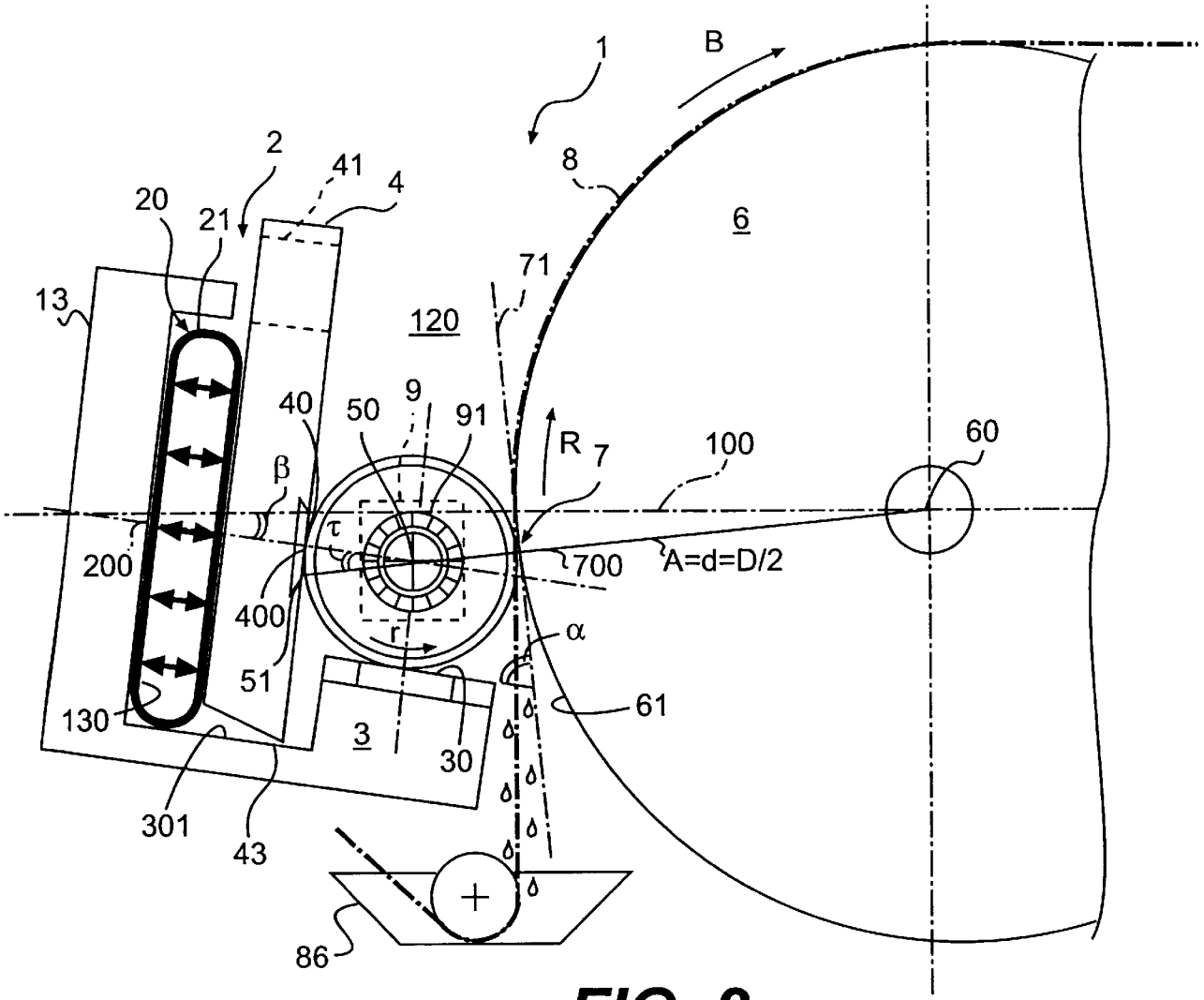
FIG. 2 is a profile cross-sectional of another device according to the invention in the working position and FIG. 3 shows, in the form of a diagram, a device according to the invention in conjunction with a compensator roller control system.
Figure 3:
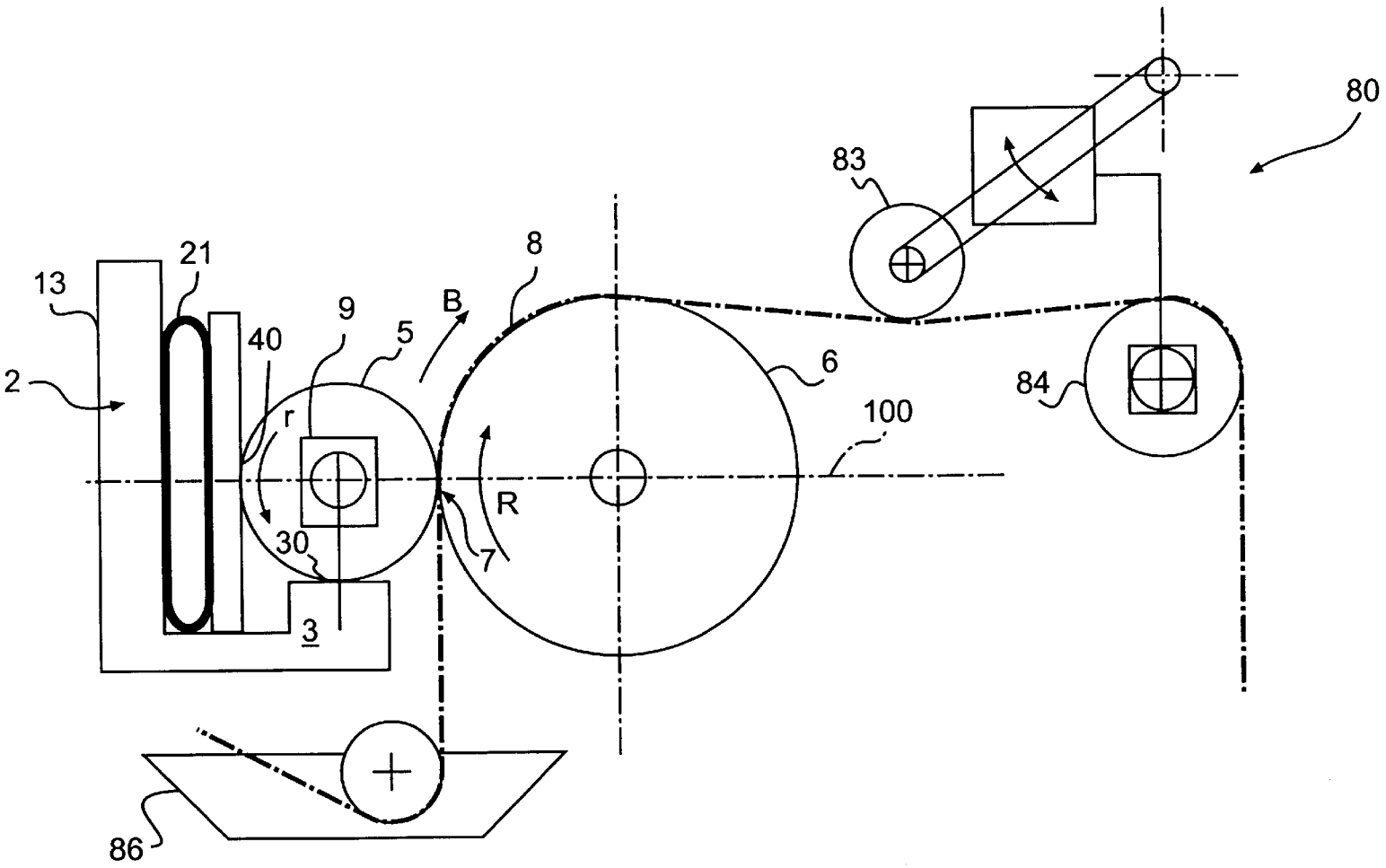

Devices 1 according to the invention dyeing machines), according to FIGS. 1 to 3, comprise a stationary support beam 13 fixed to the machine and continuous over the length of the device, a pressing facility 2 located thereon, a plate-like supporting element 3 likewise located thereon, a stationary mating roller 6 located on the machine and extending the length of the device and a working roller 5 which can be displaced to press against the latter and has a small diameter d in relation to the mating roller diameter D. The supporting element 3 engages beneath the working roller 5, whereby the latter lies on a flat sliding support body surface 30 of the support element 3.

The pressing facility 2 has a plate-like pressing body 4, continuous over the length of the device, which is fitted with a flat sliding pressing surface 40 which comes to lie against the working roller 5. By means of the pressing facility 2 the working roller 5 can be pressed against the mating roller 6 along a contact zone 7 through which the material web 8 passes so that the web 8 can be squeezed. The surface of the working roller 5 should be rubberized preferably. The core of the roller 6 consists preferably of stainless steel. The surface may be chromed, for example, or be fitted with an elastic steel made of plastic, rubber or similar material.

The working roller 5 is displaceable in all directions transversely to the length of the device and is connected at the front with a roller drive 9 comprising a drive motor via a cardan shaft 91, which does not impede the transverse movement. In contrast, the stationary mating roller 6 lacking propulsion can be rotated around its axle 60 and is mounted on a frame not depicted. In contact position it is solely the working and drive roller 5 that conducts the material web 8 through the slit between the squeezing rollers comprising the contact zone 7. At the same time, the mating roller 6 is made to revolve by means of the working roller 5.

In the embodiment example according to FIG. 1 and in the diagrammable illustration of FIG. 3 the axle 50 of the working roller 5 and the axle 60 of the mating roller 6 lie on the same horizontal plane 100. At the same time the support body surface 30 of the supporting element 3 extends parallel to the horizontal plane 100. The flat pressing surface 40 of the pressing body 4 is aligned vertically to the support body surface 30. Consequently the working roller 5 is located in a retainer, L-shaped in profile, with a pressing surface 40 that can be moved to press against the rear wall 130 of the support beam 13. This pressing surface 40 lies against the apex 51 of the working roller 5, which is determined by the distance A=d+D/2 from the axle 60 of the mating roller 6, where d is the external diameter of the working roller 5 and D the external diameter of the mating roller 6.

The diameter d of the roller, for example, is roughly half as large as the diameter D of the mating roller 6. It can be seen that, given such a dimensioning in conjunction with the roller arrangement described, the supporting element support body surface 30 extends transversely to the peripheral area 61 of the mating roller 6 spanning the area of the feed-in or supply of the material web 8. At the same time, the support body surface 30 and the imaginary tangential surface 71, which is determined by the tangent of contact shared by the two rollers 5, 6 in contact position, are aligned at an angle $\alpha \leqq 90°$. In this way the working roller 5 in the contact-free position comes to lie with its own weight against the support body surface 30.

With the embodiment example according to FIG. 2 also, the take-up and operating space for the working roller 5 is determined by an L-shaped arrangement of the sliding surfaces 40, 30 of the pressing body 4 and the supporting element 3. In contrast to the device in FIG. 1, the L-arrangement is in a tilted position at a tilt angle $\beta$ to the horizontal plane 100, on which the roller axle 60 is located. The main operating plane 200 conceived for the pressing facility 2, on which the axle 50 of the working roller 5 is located and which extends parallel to the support body surface 30, is inclined downwards with the relatively small angle $\beta$ vis-à-vis the horizontal plane 100, for example in the order of magnitude of 5° to 7°. In regular contact position the pressing surface 40 is aligned vertically to the support body surface 30. The associated regular line of contact 400, which extends the length of the device, is located at that moment on the plane 200.

As can be seen from FIG. 2, the effective lines of contact 400, 700 along the working roller 50 are also located at least approximately at the distance of the diameter d with the arrangement in tilted position and with an inclined plane 200. At the same time, the line of contact 400, viewed from the direction of rotation r of the working roller 5, lies in front of sand in proximity to the working roller apex 51, whose position is determined by the distance A=d+D/2 from the axle 60. Because of the arrangement described the angle $\alpha$ corresponding to the peripheral angle $\tau$ between the apex 51 and the regular line of contact 400 is smaller than 90°.

As depicted in FIG. 2, it is particularly advantageous that the pressing body 4 arranged so that it can be tilted against the tube elements 21 and the working roller 5 can be conceived as a plate which can be freely inserted and extracted from above and be equipped for this purpose with one or more handles 41 hatched in the drawing.

As can be seen from FIGS. 1 and 2, the working roller 5 may be comfortably handled for insertion and extraction through the space open from above between the pressing facility 2 and the mating roller 6. Thus, the pressing facility 2 needs only be operated without pressure, without any displacement or movement of the support beam 13 being required, since the opening between the pressing body 4 and the mating roller 6 conforms to the internal diameter d of the working roller 5. Conventional movable support beams become superfluous.

The pressing facility 2 usefully comprises a pressure generating facility 20 with pressure hose elements 21 distributed along the length of the device over the working width. These form contact zones covering the entire working width in rows. Each tube element is connected with a source, not depicted in the drawing, which provides a pressure medium, e.g. compressed air. With the selected pressurization of the tube elements 21, the desired contact pressure will occur over the working width.

The tube elements 21 are arranged between the stationary rear wall 130 of the support beam 13 and the rear surface of the pressing body 4, as can be seen from FIGS. 1 and 2. According to FIG. 1 the wall 130 is the floor of a guide retainer for the pressing body 4, U-shaped in profile. Consequently this can only be translated along the guide surface 301 corresponding to the support body surface 30.

As depicted in FIG. 2, however, it is particularly advantageous for pressing against to arranged the pressing body 4 so that it is displaceable with at least two degrees of freedom between the pressure hose elements 21 and the working roller 5. At the same time the pressing body 4 is formed by a plate-like beam continuous over the working width, which is positioned so that it can be tilted at its lower longitudinal edge 43 on the support-guide body surface 301 protruding from the support beam 13. As a result of this arrangement, the pressing body 4 can automatically align its flat pressing surface 40 against the working roller 5 in combination with the tube arrangement described. In operating mode any deviations from the regular contact position are compensated for, with the deviations being counteracted.

With one embodiment example, depicted in FIG. 3, seen from the direction of the web movement B, a familiar compensator roller control system 80 is provided behind the mating roller 6. A device of this type is a useful and advantageous component of the devices in FIGS. 1 and 2. It includes a pivotally mounted roller 83 and optionally a driven deflection and slip roller 84. The web 8 is conducted over the roller 84 and the roller 83 acts upon the web 8 on the section between the mating roller 6 and the guide roller 84.

In the device according to the invention, in contrast to normal systems of this type, the arrangement 80 does not control the web tension, but rather only controls the continued conveyance of the web 8 behind the roller 84. As a particularly useful embodiment of the device 1 according to the invention the arrangement 80 constitutes an advantageous auxiliary facility in combination with the device 1. In this way the arrangement 80 may be set, if required, in such a way that the conveyance of the web 8 through the contact zone 7 and the subsequent continued conveyance of the web 8 until separation from the roller 6 occur without any tensile stress being caused. This is achieved in combination with the drive contact pressure, which is effected by the axial drive 9 acting upon the displaceable working roller 5 and which in the course of the power transfer from the working roller 5 via the contact zone 7 operates through the web 8 onto the roller 6 or rather the section of web partly wrapped around the latter. Thus the exclusive induction of the drive power provided according to the invention from the working roller 5 to the revolving movement of the roller 6 is achieved in an optimum manner.

What is claimed is:

1. An apparatus for processing a material web, said apparatus defining a lengthwise direction essentially perpendicular to a direction of processing of said web over a working width, and comprising stationary roller means arranged to extend in said lengthwise direction of said apparatus, adapted to revolve about a stationary axle;

working roller means arranged to be displaceable and to be pressed against said stationary roller means, said working roller means being driven to revolve about a displaceable axle and having a working roller diameter which is smaller than a diameter of said stationary roller means;

pressing means associated with said working roller means to press said working roller means against said stationary roller means along a contact zone in a pressing operation, said contact zone being continuous over said working width while permitting said material web to pass through said contact zone, said pressing means including a pressing body with a pressing surface, engaging with said working roller means on a peripheral area of said working roller means opposite said contact zone;

supporting means, arranged separately from said pressing body, and defining support surface means engaging with said working roller means during said pressing operation; and roller drive means associated with said working roller means and adapted to drive said working roller means to perform peripheral driving of said stationary roller means, wherein said working roller means, when in a driven state and when pressed against said stationary roller means during said pressing operation, drives said material web through said contact zone;

said supporting means, when viewed in a direction of rotation of said working roller means, is located upstream of said contact zone in an area between said contact zone and said pressing means; and further including a supply area for supplying said web into said contact zone that is provided between said supporting means and said stationary roller means.

2. An apparatus as claimed in claim 1, wherein said support surface means extends transversely with respect to a peripheral section of said stationary roller means forming part of said supply area for said web.

3. An apparatus as claimed in claim 1, wherein said support surface means is formed as a flat surface.

4. An apparatus as claimed in claim 1, wherein said pressing body is fitted with a flat pressing surface.

5. An apparatus as claimed in claim 1, wherein said supporting means and said pressing body have flat surfaces arranged at least approximately at right angles to each other.

6. An apparatus as claimed in claim 1, wherein said pressing body lies against an apex of said working roller means, said apex being determined by the distance $A=d+D/2$ from the axle of said stationary roller, wherein d is the diameter of said working roller means and D is the diameter of said stationary roller means.

7. An apparatus as claimed in claim 1, wherein said pressing surface of said pressing body lies against said working roller means in proximity to a working roller apex, which is determined by a distance $A=d+D/2$, with d being the working roller means diameter and D being the stationary roller means diameter, from the axle of said stationary roller means.

8. An apparatus as claimed in claim 1, wherein said support surface means and an imaginary tangential surface, which is determined by a tangent of contact shared by said stationary and working roller means when in press contact, are aligned at an angle $\alpha \leqq 90°$, wherein the distance, measured in a straight line, between a contact point of said pressing body and the contact point of said stationary roller means corresponds at least approximately to the diameter (d) of said working roller means.

9. An apparatus as claimed in claim 1, wherein said stationary roller means, said pressing body and said supporting means are arranged so that the weight of said working roller means is supported by said support body surface.

10. An apparatus as claimed in claim 1, wherein said axles of said working roller means and said stationary roller means lie on the same horizontal plane, said web running in a direction (B) from bottom to top and said working roller means, in said pressing operation, resting on said support surface means located below said working roller means.

11. An apparatus as claimed in claim 1, wherein said apparatus includes a compensator roller control means which engages said web running off said stationary roller means along a stretch of said web downstream of said stationary roller without causing tensile stress in said web.

12. An apparatus as claimed in claim 1, wherein said pressing body is movable with at least two degrees of freedom between pressure generating means of said pressing means and said working roller means.

13. An apparatus as claimed in claim 1, wherein said apparatus comprises pressure generating means forming part of said pressing means and having at least one pressure tube element operating against said pressing body and extending lengthwise along said working width.

14. An apparatus as claimed in claim 1, wherein said pressing body includes a plate, which is adapted for installation and removal through an empty space above said working roller means.

* * * * *